US007066078B2

(12) United States Patent
Ono et al.

(10) Patent No.: US 7,066,078 B2
(45) Date of Patent: Jun. 27, 2006

(54) PISTON FOR INTERNAL COMBUSTION ENGINE

(75) Inventors: Tai Ono, Tokyo (JP); Tatsuru Fukuda, Tokyo (JP); Tsuyoshi Hanakawa, Tokyo (JP)

(73) Assignee: Fuji Jukagyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/903,397

(22) Filed: Jul. 30, 2004

(65) Prior Publication Data

US 2005/0034597 A1 Feb. 17, 2005

(30) Foreign Application Priority Data

Aug. 11, 2003 (JP) ..... 2003-291728

(51) Int. Cl.
*F02F 3/00* (2006.01)

(52) U.S. Cl. ..... 92/228; 92/213; 92/208

(58) Field of Classification Search ..... 92/208, 92/212, 213, 228
See application file for complete search history.

(56) References Cited

U.S. PATENT DOCUMENTS 4,662,326 A * 5/1987 Kohnert ..... 123/193.6
4,679,493 A * 7/1987 Munro et al. ..... 92/212
4,730,548 A * 3/1988 Maeda et al. ..... 92/225
4,831,918 A * 5/1989 Mielke et al. ..... 92/222
4,920,864 A * 5/1990 Skingle et al. ..... 92/213
4,986,231 A * 1/1991 Brown ..... 92/212

FOREIGN PATENT DOCUMENTS

| | | |
|---|---|---|
| DE | 39 32 562 A1 | 4/1991 |
| JP | 56-167831 | 12/1981 |
| JP | 58-86968 | 5/1983 |
| JP | 01-273859 | 11/1989 |
| JP | 11-285809 | 10/1999 |

* cited by examiner

*Primary Examiner*—Thomas E. Lazo
(74) *Attorney, Agent, or Firm*—Smith, Gambrell & Russell

(57) ABSTRACT

By casting a preformed member composed of a fiber reinforced material into a base material of a piston, a pair of crown reinforcing portions corresponding to respective pin boss portions are formed on a crown portion, and the pair of crown reinforcing portions are connected to each other along the piston pin axis by a connecting portion. Thus, the strength of the piston is increased by the crown reinforcing portions, and also, heat distortion of the crown portion is inhibited since the crown reinforcing portions integrally connected to each other by the connecting portion are formed so as to serve as a rigid member extending along the piston pin axis.

4 Claims, 4 Drawing Sheets

PISTON FOR INTERNAL COMBUSTION ENGINE

This application claims benefit of Japanese Application No. 2003-291728 filed on Aug. 11, 2003, the contents of which are incorporated by this reference.

BACKGROUND OF THE INVENTION

1. Field of the Invention

The present invention relates to a piston for an internal combustion engine, reinforced by casting a preformed member composed of a fiber reinforced material into a piston base material.

2. Description of the Related Art

Hitherto, with respect to the piston for the internal combustion engine such as a gasoline engine or a diesel engine, in order to improve combustion by optimizing gas flow, to make weight reduction, to improve fuel economy by ensuring a stroke, and to raise an acceleration performance and so forth, a crown portion of the piston has been developed so as to have a thin or reduced wall.

In the meantime, since the crown portion is directly subjected to combustion of air-fuel mixture, when the wall of the crown portion is thinned, countermeasures against a crack, meltdown, penetration, and the like are strongly required in order to maintain its strength and roundness against heat distortion caused by heat deflection.

In view of the above requirement, for example, Japanese Examined Patent Application Publication No. 7-86336 discloses the piston having a structure in which the strength of the crown portion (head portion) is increased by casting a steel skeleton member having a round core portion of the head portion, core portions of a pair of pin boss portions, skirt ribs, a skirt portion, and an engaging portion of a top ring integrally connected thereto into a light alloy base material (reinforcement material) and also, a heat dissipation effect is improved by thermal conduction to a cylinder or the like through the skeleton member of the piston.

Also, for example, Japanese Unexamined Patent Application Publication No. 11-285809 discloses the piston having a structure in which the strength of the piston is partially increased by casting a preformed member composed of a fiber reinforced material or the like into the base material of the piston.

However, when the steel skeleton member is casted in the base material of the piston as disclosed in the above-mentioned Japanese Examined Patent Application Publication No. 7-86336, there is a risk of an inadequate bonding strength between these different materials from each other.

As a countermeasure against the above-problem, there is a possibility of increasing the strength between the different materials from each other by forming the above-mentioned skeleton member with a preformed member. However, since the skeleton member disclosed in the above-mentioned Japanese Examined Patent Application Publication No. 7-86336 has a complicated structure for achieving a necessary stiffness and inhibiting thermal expansion, when the preformed member having such a complicated structure is casted, a flow of molten metal becomes complicated, as a result, the molten metal is impregnated less in the preformed member, thereby causing a risk of an inadequate strength of a part of the piston reinforced with a fiber reinforced metal of which the preformed member is composed.

In view of the above-mentioned problems, the present invention has been made. Accordingly, it is an object of the present invention to provide the piston for the internal combustion engine, achieving a necessary strength thereof and also inhibiting distortion of the crown portion while having a simple structure, even when the crown portion has a thin wall.

SUMMARY OF THE INVENTION

The piston for the internal combustion engine formed by casting a preformed member composed of a fiber reinforced material into a piston base material according to the present invention includes, a pair of pin boss portions;

a pair of crown reinforcing portions disposed on a crown portion so as to arrange above the respective pin boss portions; and a connecting portion connecting the pair of crown reinforcing portions to each other along the piston pin axis.

The preformed member is formed at least by the pair of crown reinforcing portions and the connecting portion.

DETAILED DESCRIPTION OF THE PREFERRED EMBODIMENTS

Figure 1:
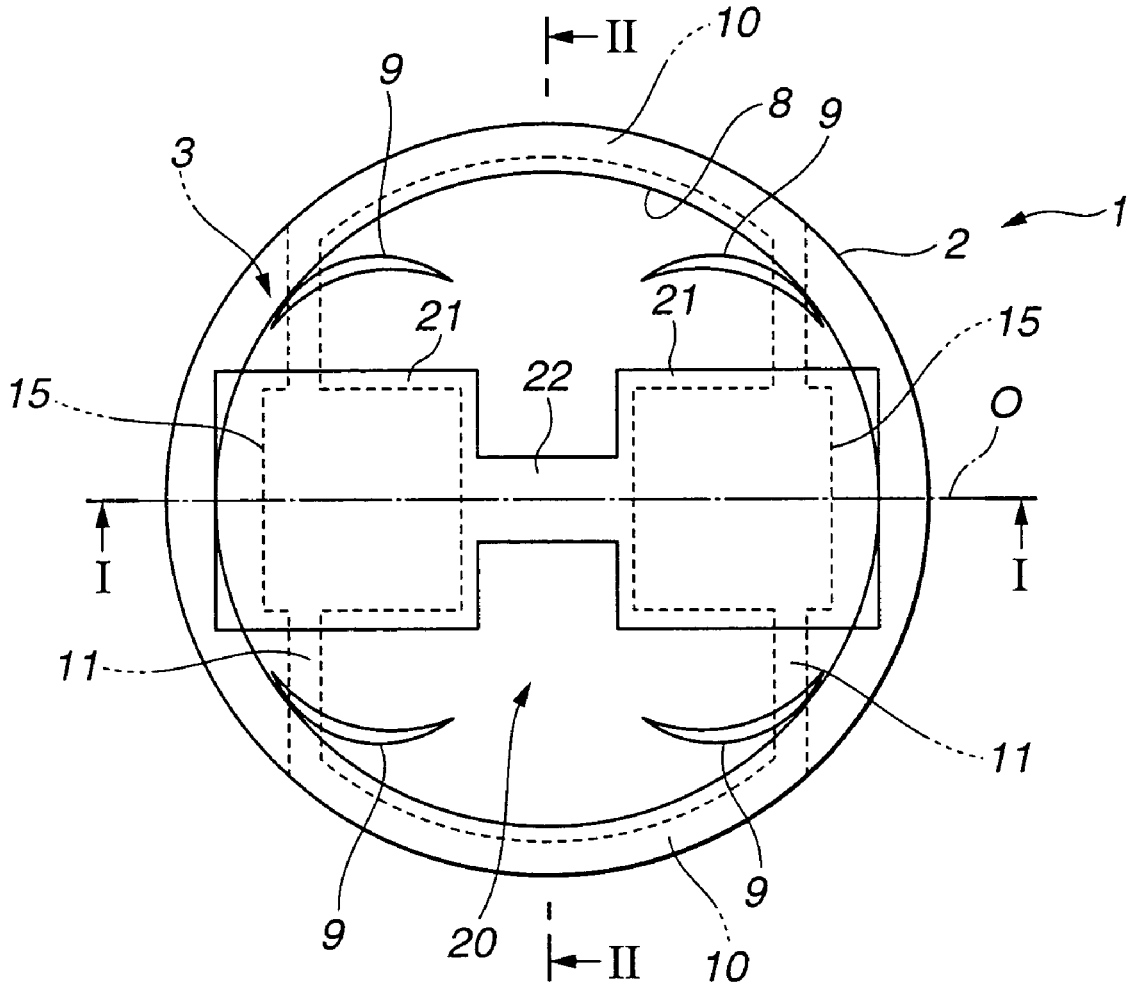
FIG. 1 is a plan view of a piston according to an embodiment of the present invention.
Figure 5:
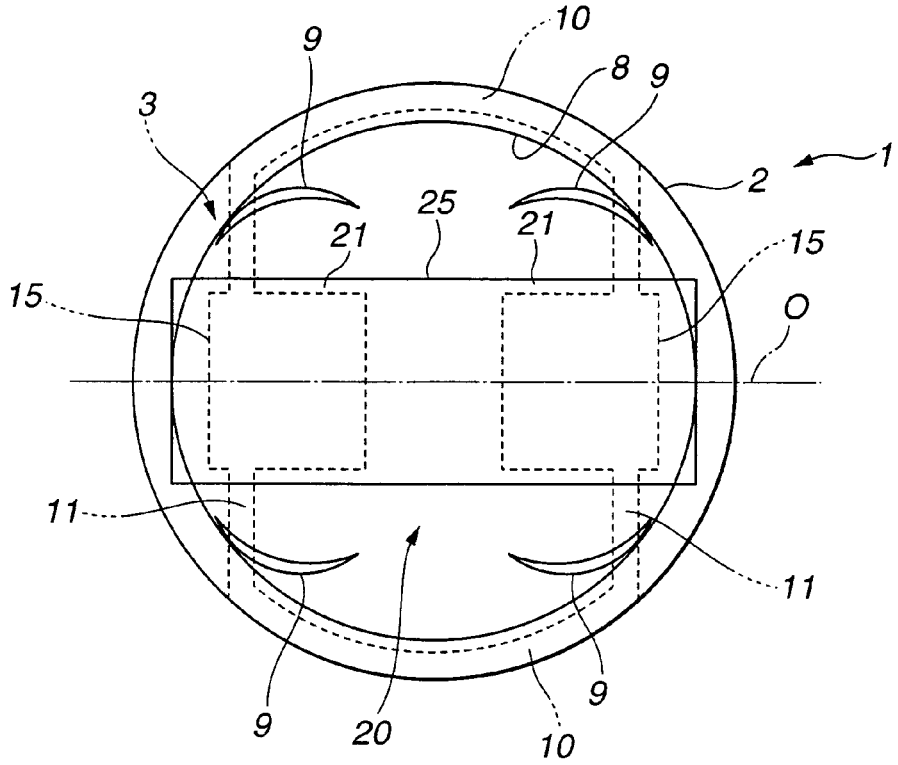
FIG. 5 is a plan view of a modification of the piston.
Figure 6:
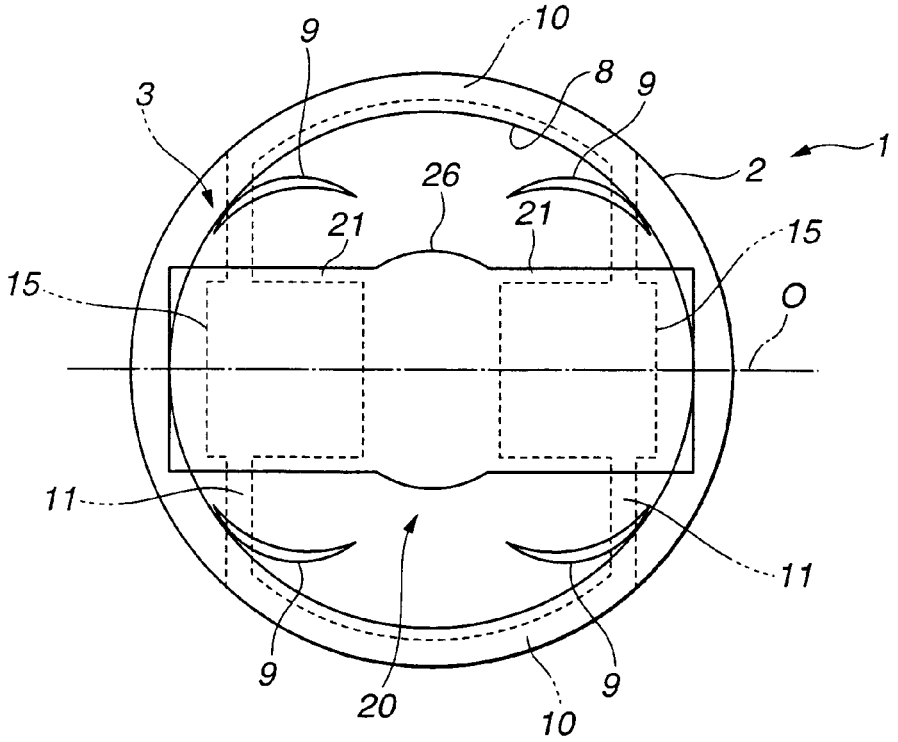
FIG. 6 is a plan view of anther modification of the piston.

Preferred embodiments of the present invention will be described with reference to the accompanying drawings. FIG. 1 is a plan view of a piston according to an embodiment of the present invention, FIGS. 2 and 3 are sectional views of the piston respectively taken along the lines I—I and II—II indicated in FIG. 1, FIGS. 4A to 4C are respectively a plan view, an elevation view, and a right side view of a preformed member, FIGS. 5 and 6 are plan views of modifications of the piston.

Figure 2:
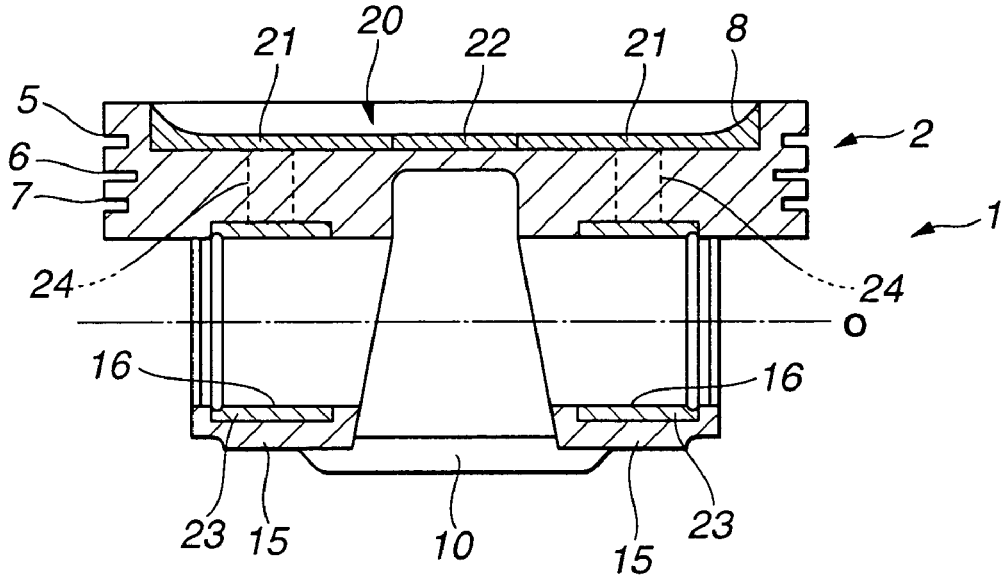
FIG. 2 is a sectional view of the piston taken along the line I—I indicated in FIG. 1.
Figure 3:
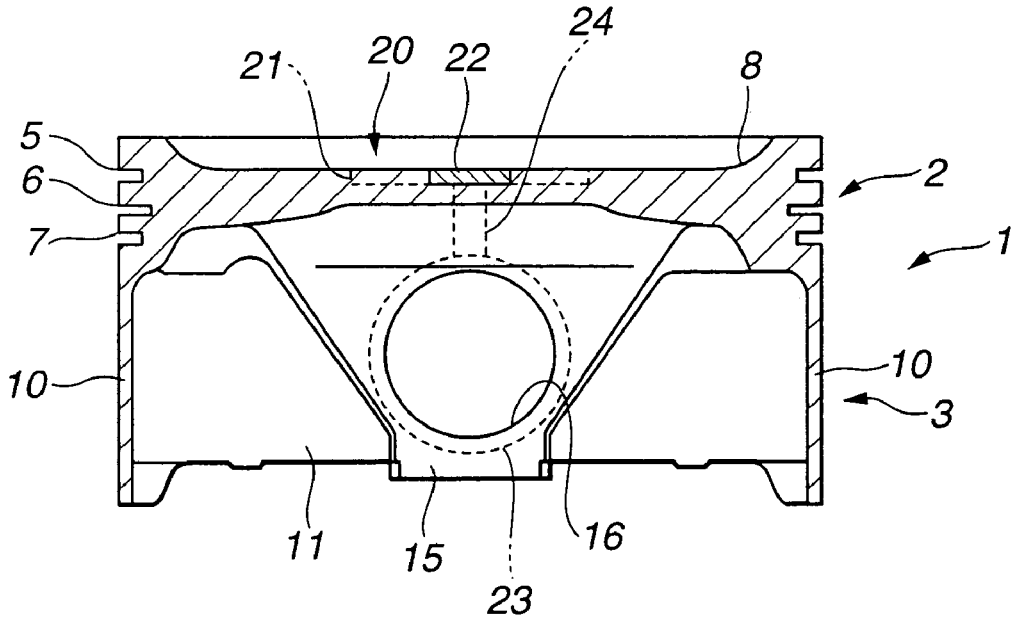
FIG. 3 is a sectional view of the piston taken along the line II—II indicated in FIG. 1.

As shown in FIGS. 1 to 3, a piston 1 for an internal combustion engine according to an embodiment of the present invention is used for, for example, a horizontally opposed gasoline engine and is a casting article composed of an aluminum alloy (for example, having a coefficient of thermal expansion of $21.0\times10^{-6}/°$ C.) as a base material (piston base material).

The piston 1 is defined by a crown portion 2 formed in substantially disc-shaped, and a skirt portion 3 extending from the rear surface (lower surface) of the crown portion 2.

The crown portion 2 has a top ring groove 5, a second ring groove 6, and an oil ring groove 7 formed in the outer circumferential surface thereof in that order from above. The top ring groove 5 and the second ring groove 6 receive respective compression rings (not shown) disposed therein so as to achieve hermeticity of a combustion chamber. The oil ring groove 7 receives also an oil ring (not shown) disposed therein so as to scrape a redundant part of a lubricant oil film formed on the wall of a cylinder.

Also, the crown portion 2 has a cavity 8 as a part of the combustion chamber, formed in the upper surface thereof in a recessed manner. In addition, the cavity 8 has valve recesses 9 corresponding to respective intake and exhaust valves (not shown) of the engine formed therein in a recessed manner.

The skirt portion 3 is defined by a pair of arch-shaped portions 10 and a pair of boss-supporting-wall portions 11 connecting the mutually facing ends of the arch-shaped portions 10.

The arch-shaped portions 10 are symmetrically disposed with respect to the center axis of the crown portion 2 so as to face each other, and the outer walls thereof have partially arch-shaped, curved surfaces extending substantially along the outer circumferential surface of the crown portion 2.

The boss-supporting-wall portions 11 are defined by substantially flat-shaped members disposed on the rear surface of the crown portion 2 in a standing manner so as to be parallel to each other and have respective pin boss portions 15 integrally formed therewith. The pin boss portions 15 have respective pin holes 16 perforated therethrough, and the piston 1 is connected to a connecting rod (not shown) by a piston pin (not shown) fitted into the pin holes 16.

The piston 1 having the above-described structure has a fiber reinforced metal portion 20 disposed in the major part thereof. The fiber reinforced metal portion 20 including a high-strength, fiber reinforced material is a fiber reinforced metal region (FRM region) formed such that the fiber reinforced material is integrally combined with an aluminum alloy.

As illustrated in the figures, the fiber reinforced metal portion 20 is defined by a pair of crown reinforcing portions 21 disposed on the crown portion 2 so as to arrange above the pin boss portions 15, a connecting portion 22 integrally connecting these crown reinforcing portions 21, boss reinforcing portions 23 disposed in the respective pin boss portions 15, and connecting portions 24 connecting the boss reinforcing portions 23 to the corresponding crown reinforcing portions 21.

By estimating stresses of corresponding elements of the piston 1 caused by, for example, a combustion pressure exerted on the upper surface of the crown portion 2 and an inertia force during the exhaust stroke, with using the finite element method or the like, each crown reinforcing portions 21 is disposed at a predetermined portion of the piston 1 around the corresponding pin boss portion 15 (for example, a portion of the piston 1 having a strength with a safety margin not greater than a predetermined value regarding its material fatigue strength) in accordance with the estimated stresses. In the present embodiment, the crown reinforcing portion 21 is formed so as to have, for example, a rectangular shape covering the corresponding pin boss portion 15 when viewed from the upper surface of the crown portion 2 (see FIG. 1) and have a thickness (depth) of about 5 to 10 mm (see FIG. 2).

The connecting portion 22 integrally connects the two crown reinforcing portions 21 to each other along the piston pin axis O. In the present embodiment, on the upper surface of the crown portion 2, a width of the connecting portion 22 extending in a direction perpendicular to the piston pin axis O is set so as to be smaller than that of each crown reinforcing portion 21 (see FIG. 1) and a thickness (depth) of the connecting portion 22 is set about 5 to 10 mm (see FIGS. 2 and 3).

As obvious from FIG. 1, the two crown reinforcing portions 21 and the connecting portion 22 are symmetrical with respect to the piston pin axis O, and the added value of lengths of these components extending along the piston pin axis O is set so as to be, for example, 90% or more of the diameter of the crown portion 2.

Each boss reinforcing portion 23 is defined by an annular member surrounding the corresponding pin hole 16 and is connected to the corresponding crown reinforcing portion 21, having the corresponding connecting portion 24 interposed therebetween.

The fiber reinforced metal portion 20 having the above-mentioned structure is formed by casting a preformed member 30 composed of a fiber reinforced material into the base material at the time of casting of the piston 1.

In the present embodiment, the fiber reinforced material is composed of thin metal wires having a coefficient of thermal expansion smaller than that of the base material (aluminum alloy) of the piston 1. More particularly, the fiber reinforced material is made by dispersing thin metal wires therein at a predetermined volume ratio (for example, the volume ratio of thin metal wires 20 to 25%), composed of, for example, an Fe—Cr base heat resisting steel (represented by Fe—Cr—Si), each having a diameter of about 0.1 mm and a coefficient of expansion of $11.6\times10^{-6}/°$ C.

Figure 4A:
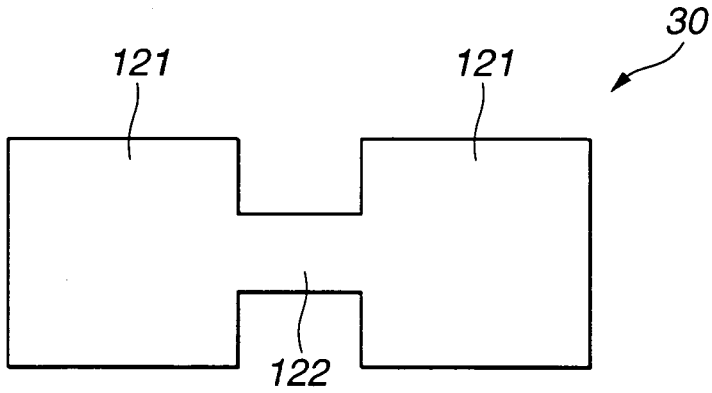
FIG. 4A is a plan view of a preformed member.
Figure 4B:
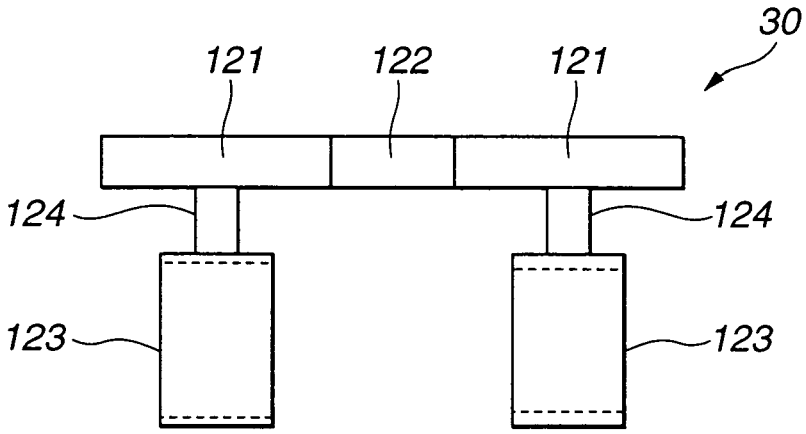
FIG. 4B is an elevation view of the preformed member.
Figure 4C:
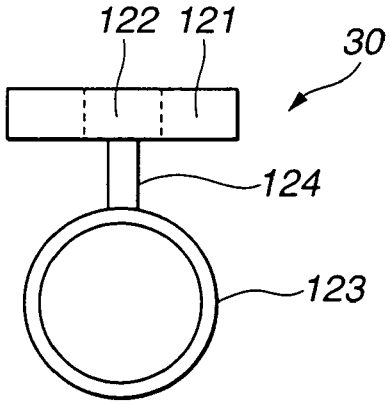
FIG. 4C is a right side view of the preformed member.

Then, by processing the fiber reinforced material, the preformed member 30 integrally including portions 121 for forming the corresponding crown reinforcing portions 21, a portion 122 for forming the corresponding connecting portion 22, portions 123 for forming the corresponding boss reinforcing portions 23, and portions 124 for forming the corresponding connecting portions 24 is formed (see FIGS. 4A to 4C).

Subsequently, by setting the preformed member 30 in a mold die, pouring molten aluminum metal in the mold die while controlling the flow direction of the molten metal, and applying pressure on the preformed member 30, the piston 1 including the fiber reinforced metal portion 20 is casted. Meanwhile, in the preformed member 30, since the portion 121 for forming the crown reinforcing portion 21 is formed so as to have an excessive thickness, a redundant part of the thickness is removed, for example, by cutting when the cavity 8 is formed after the casting is finished.

According the above-described embodiment, when the preformed member 30 is casted, the pairs of the crown reinforcing portions 21 and the boss reinforcing portions 23 are formed, and also, the pair of crown reinforcing portions 21 are connected to each other along the piston pin axis O by the connecting portion 22, thereby achieving a necessary strength of the piston 1 and also inhibiting distortion of the crown portion 2 while allowing the piston 1 to have a simple structure even when the crown portion 2 has a thinned wall.

In other words, by restrictively forming reinforcing portions in regions (predetermined regions of the crown portion 2 corresponding to the pin boss portions 15 and the pin boss portions 15) in which stresses are mostly concentrated, so as to thin the wall of the crown portion 2, the fiber reinforced metal portion 20 having a simple structure and effectively providing a necessary strength of the piston 1 is achieved. Meanwhile, it is known that stresses on the crown portion 2 and the pin boss portions 15 are correlative to each other, that is, the greater the strength of the crown portion 2, stresses of the pin boss portions 15 further decrease. Accordingly, in the case where the strength of the crown portion 2 is satisfactorily achieved by the crown reinforcing portions 21 even when the wall of the crown portion 2 is thinned, the boss reinforcing portions 23 and the connecting portions 24 of the same can be eliminated. Thus, by eliminating the boss reinforcing portions 23 and the connecting portions 24 as described above, the crown portion 2 has a thinned wall with the piston 1 having a simpler structure.

Since the two crown reinforcing portions 21 are integrally connected to each other along the piston pin axis O by the connecting portion 22, heat distortion of the crown portion 2 is inhibited, thereby maintaining the roundness of the piston 1. That is, it is known that the crown portion is deformed into an elliptical shape due to heat distortion of each portion of the piston and the like, and an internal stress which is generated in the crown portion especially under heavy load combustion conditions and which causes the crown portion to expand in the direction perpendicular to the piston pin axis (in other words, the internal stress causing the crown portion to contract along the piston pin axis). Hence, by connecting the two crown reinforcing portions 21 to each other by the connecting portion 22 so as to serve as a solid rigid member continuously and integrally extending along the piston pin axis O, distortion due to the internal stress of the crown portion 2 can be inhibited, and the roundness of the crown portion 2 can be maintained at a high level. In other words, focusing attention on the fact that the internal stress is generated along the piston pin axis O when the crown portion 2 is distorted by heat, the crown reinforcing portions 21 disposed along the piston pin axis O are connected by the connecting portion 22 so as to serve as a rigid member against the internal stress, thereby achieving countermeasures against distortion of the crown portion 2 with the piston 1 having a simple structure. Meanwhile, by setting the added length of the two crown reinforcing portions 21 and the connecting portion 22 along the piston pin axis O at a predetermined value (for example, at least 90% of the diameter of the crown portion 2), distortion of the crown portion 2 can be effectively inhibited.

Thus, with the simple structure as mentioned above, a necessary strength of the piston is achieved and also heat distortion of the crown portion 2 is inhibited, thereby making the shape of the preformed member 30 to be casted simple. Accordingly, the flow of molted metal is simplified at the time of casting and is accurately controlled, whereby a fiber reinforced material can be transformed into a fiber reinforced metal member having a high strength and a high impregnation factor.

On this occasion, as shown in FIG. 1, by setting the width of the connecting portion 22 at the minimum value required for the connecting portion 22 to serve as a rigid member, the preformed member 30 has a less volume, and the flow of molten metal can be controlled more simply.

Meanwhile, in the present embodiment, for example, as shown in FIG. 5, the two crown reinforcing portions 21 may be connected to each other by a connecting portion 25, in place of the connecting portion 22, having a width extending on the upper surface of the crown portion 2 in the direction perpendicular to the piston pin axis O and set so as to be the same as that of each crown reinforcing portion 21. By setting the widths of the crown reinforcing portions 21 and the connecting portion 25 so as to be the same as each other, the preformed member 30 has a simpler shape.

Also, for example, as shown in FIG. 6, the two crown reinforcing portions 21 may be connected to each other by a connecting portion 26, in place of the connecting portion 22, having a width extending on the upper surface of the crown portion 2 in the direction perpendicular to the piston pin axis O and set so as to be greater than that of each crown reinforcing portion 21. In this case, for example, by forming the connecting portion 26 so as to have arch-shaped portions protruding in the direction perpendicular to the piston pin axis as shown in the figure, the piston 1 expands by heat evenly in the radial direction thereof. Also, by setting the width of the connecting portion 22, extending in the direction perpendicular to the piston pin axis O, so as to be greater than that of the crown reinforcing portion 21, the piston 1 has an increased stiffness in this direction.

Having described the preferred embodiments of the invention referring to the accompanying drawings, it should be understood that the present invention is not limited to those precise embodiments and various changes and modifications thereof could be made by one skilled in the art without departing from the spirit or scope of the invention as defined in the appended claims.

What is claimed is:

1. A piston for an internal combustion engine formed by casting a preformed member composed of a fiber reinforced material into a piston base material, comprising:

a pair of pin boss portions;

a pair of crown reinforcing portions disposed on a crown portion so as to arrange above the respective pin boss portions; and a connecting portion connecting the pair of crown reinforcing portions to each other along the piston pin axis, wherein the preformed member is formed at least by the pair of crown reinforcing portions and the connecting portion, said pair of boss reinforcing portions reinforcing the respective pin boss portions, wherein the preformed member is formed such that the pair of boss reinforcing portions are integrally formed with the respective crown reinforcing portions.

2. The piston according to claim 1, wherein the connecting portion has a width extending on the crown portion in the direction perpendicular to the piston pin axis and set so as be smaller than that of each crown reinforcing portion.

3. The piston according to claim 1, wherein the connecting portion has a width extending on the crown portion in the direction perpendicular to the piston pin axis and set so as be the same as that of each crown reinforcing portion.

4. The piston according to claim 1, wherein the connecting portion has a width extending on the crown portion in the direction perpendicular to the piston pin axis and set so as be greater than that of each crown reinforcing portion.

* * * * *